United States Patent [19]

Jammes

[11] Patent Number: 4,562,868

[45] Date of Patent: Jan. 7, 1986

[54] METHOD FOR MAKING A WOVEN BAND

[76] Inventor: Michel Jammes, 4300 LePux, Haute-Loire, France

[21] Appl. No.: 468,778

[22] Filed: Feb. 22, 1983

Related U.S. Application Data

[63] Continuation-in-part of Ser. No. 123,902, Feb. 22, 1980, abandoned.

[30] Foreign Application Priority Data

Feb. 28, 1979 [FR] France ..... 79 05814

[51] Int. Cl.[4] ..... D03D 13/00

[52] U.S. Cl. ..... 139/118; 139/385; 139/422

[58] Field of Search ..... 139/116, 117, 118, 431, 139/432, 385, 421, 422

[56] References Cited

U.S. PATENT DOCUMENTS 3,152,620 10/1964 Libby ..... 139/385
3,250,301 5/1966 Randall ..... 139/118
3,957,088 5/1976 Muller et al. ..... 139/117

FOREIGN PATENT DOCUMENTS 2017446 11/1970 Fed. Rep. of Germany ..... 139/117
2036816 7/1980 United Kingdom ..... 139/118

*Primary Examiner*—Henry S. Jaudon
*Attorney, Agent, or Firm*—Eric P. Schellin

[57] ABSTRACT

A method for manufacturing a woven band having novel yarn patterns by crosswise motion and hooking of warp threads on or within the stitch selvedge of an elastic rigid woven band. A thrower 3 includes a means for hooking and transversely shifting one or more warp threads and/or one or more intermediate yarns in the direction of the warp threads to the body of the article being made. The shifting of one of these yarns is effected in accordance with a pre-determined cycle. The yarns are thereafter either meshed or inserted within the mesh to obtain embroidery effects or runproof products.

14 Claims, 17 Drawing Figures

FIG. 1
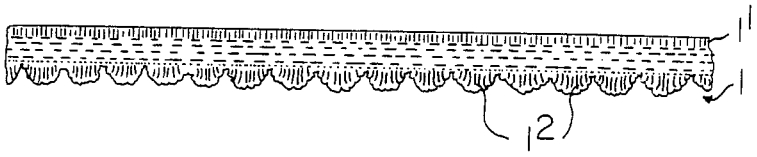
FIG. 2
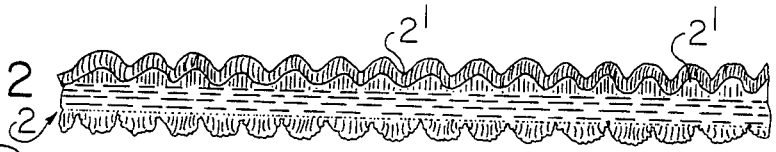
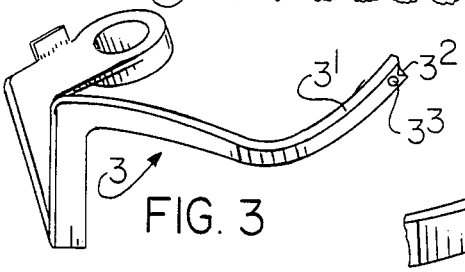
FIG. 3
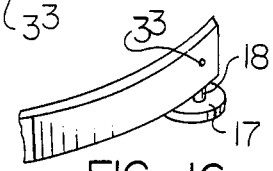
FIG. 16
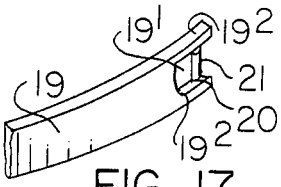
FIG. 17
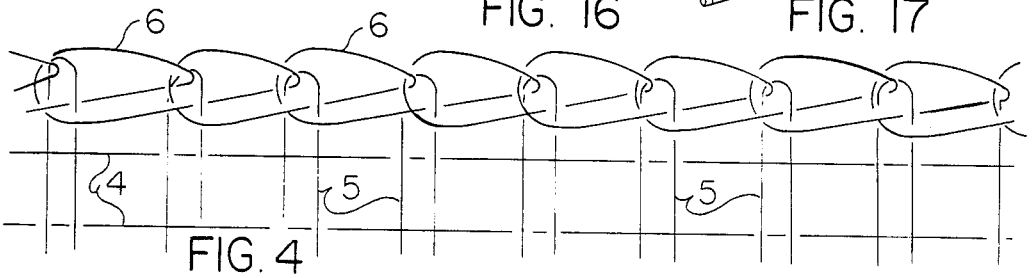
FIG. 4
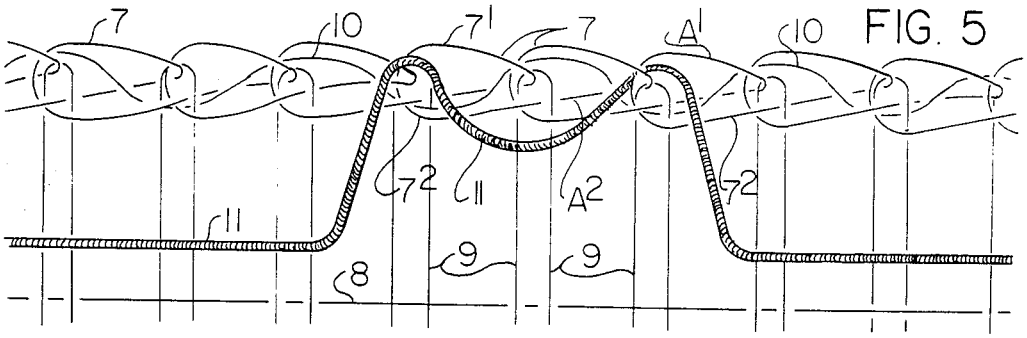
FIG. 5
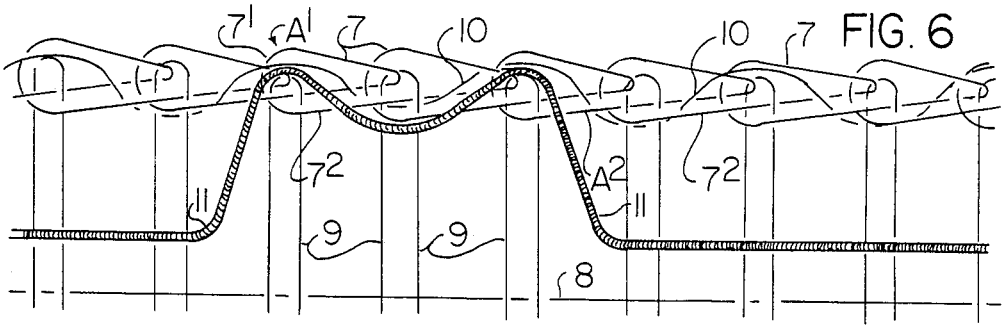
FIG. 6

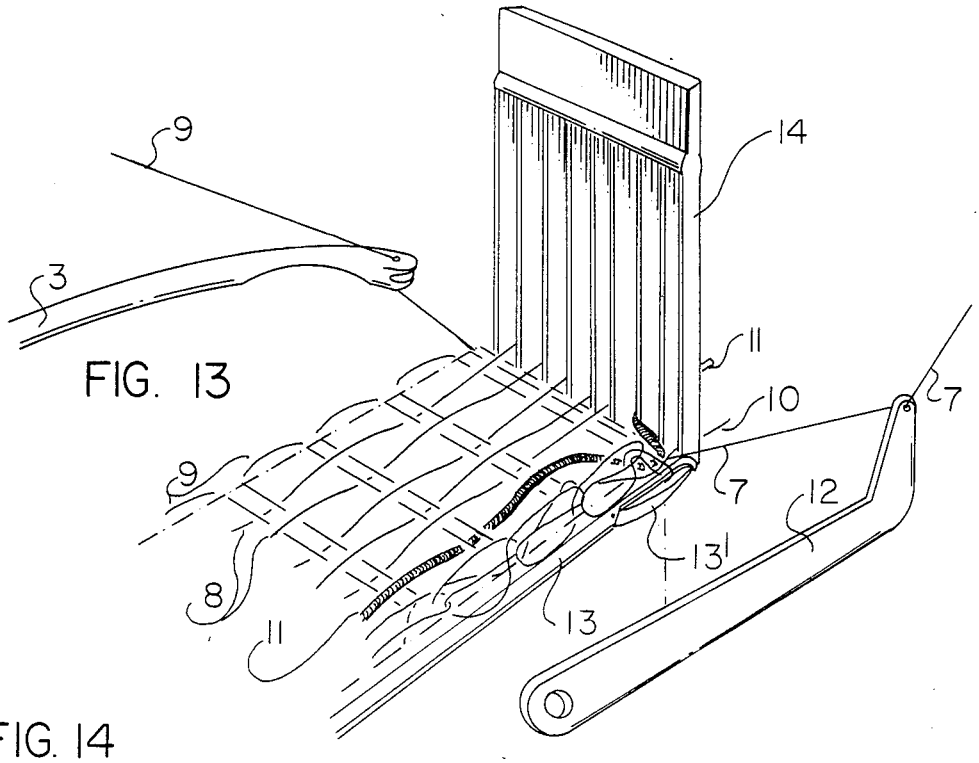
FIG. 13
FIG. 14
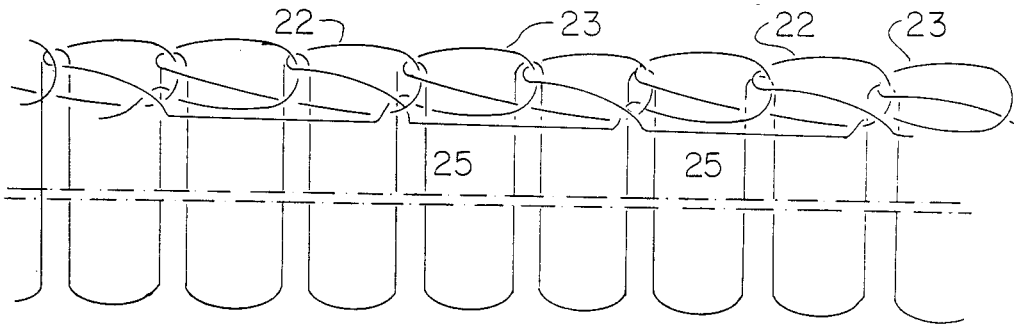
FIG. 15
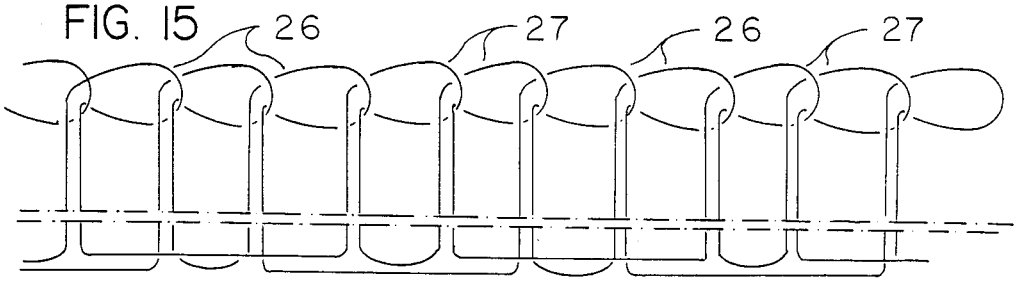

METHOD FOR MAKING A WOVEN BAND

CROSS REFERENCE TO RELATED APPLICATIONS

This application is a continuation-in-part of my copending application Ser. No. 123,902, filed Feb. 22, 1980, now abandoned.

The present invention relates to weaving.

The object of the present invention is to provide novel yarn patterns on elastic or rigid woven bands by means of a simple device mounted on a loom. According to one embodiment, it is possible to obtain scallops or protruding rounded heads on one or both edges of an elastic band which is woven on a sickle loom.

In FIG. 1 of the drawings there is shown a conventional elastic band 1 with a stitch selvedge $1^1$ and a scallop $1^2$ formed in the edge opposite the stitch selvedge. This scallop comprises a brass wire, in accordance with the prior art. It is not possible at present to obtain patterns on the stitch selvedge side, except for a simple weft loop made with a special mechanism beside the filler yarn system mounted on the loom.

The problem to be solved was to insert a means for forming scallops in combination with forming a selvedge within the stitch selvedge. The method of the present invention makes it possible to form a scallop on the stitch selvedge of a woven elastic band or bandage.

In another application of the present invention, it is possible to make a runproof elastic or rigid woven band.

Other applications will be described in the course of the following specification.

The process of the present invention is particularly novel and useful in that the thrower or weft-winder of the loom has means for hooking and shifting transversely to the body of the article one or more warp threads and/or one or more intermediate threads which are disposed in the direction of the warp threads. These threads are shifted in accordance with a predetermined cycle. The threads are thereafter meshed or inserted within the mesh to obtain embroidery patterns or runproof products.

The weft thread inserting member, hereinafter called thrower, is provided adjacent to the end thereof, with an opening or eyelet through which the weft thread is guided. According to a main feature of the invention, a cut-out with horizontal axis is formed by this end for the engagement and guiding of the warp thread or threads, and/or of the intermediate threads.

In accordance with a first embodiment of the invention a scallop is formed on the stitch selvedge side of a woven elastic band by inserting at least two elastic threads with different tension within the interior of the mesh course, which is formed by the filler yarn system. The mechanism of the thrower provides, in accordance with a pre-determined cycle, insertion simultaneously or in succession of two elastic threads between the loops and stitch legs of the chain, in combination with the passage of the weft yarn.

In another embodiment of the invention, several elastic or nonelastic yarns of the warp thread sheet are shifted transversely of their normal working position by the thrower, and are either meshed or inserted within the stitch to obtain embroidery patterns or runproof products.

To define the object of the invention without restricting it thereto, reference is made to the attached drawings, in which:

FIG. 1 is a view illustrating a woven elastic band which has, in a known manner, a meshed or stitch selvedge and a scallop on the opposite side;

FIG. 2 is a view illustrating the item made according to the present invention, and showing a woven elastic band with the formation of a scallop on the stitch selvedge side;

FIG. 3 is a perspective view of the thrower;

FIG. 4 is a diagrammatical view of a conventional meshing;

FIG. 5 is a diagrammatical view of a meshing in accordance with the present invention;

FIG. 6 is a diagrammatical view illustrating an alternative embodiment for the meshing of FIG. 5;

FIGS. 12 and 13 illustrate, as another embodiment of FIGS. 10 and 11, the steps of the process for weaving elastic bands on a loom, with a stitch selvedge having the type of scallops as defined diagrammatically by FIG. 6.

FIG. 14 illustrates a further embodiment of the invention in the formation of a runproof product comprising two or more rigid or elastic filler yarns while causing them to work alternately.

FIG. 15 illustrates an alternative form of a runproof product comprising two or more binding yarns which alternately function as weft yarns.

FIG. 16 is a perspective view in part, illustrating the thrower in accordance with another embodiment, the thrower being provided with an idle roller for preventing overtensions.

FIG. 17 is a perspective view in part, illustrating another embodiment of the thrower.

Figure 7:
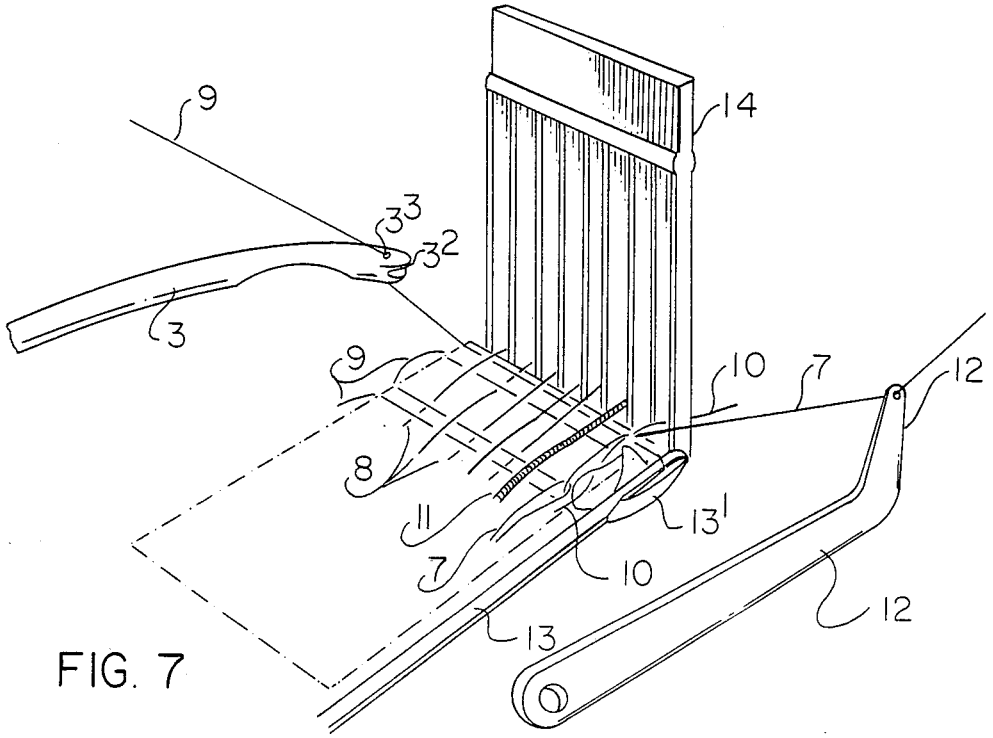
FIGS. 7, 8, 9, 10 and 11 illustrate the various steps of the manufacturing process in accordance with the embodiment of the present invention of elastic bands woven on a loom, with a stitch selvedge having scallops similar to the ones defined diagrammatically by FIG. 5.

FIGS. 1 and 2 show, respectively, an elastic band provided with scallops woven on a weft-winder loom and made (FIG. 1) in the conventional manner and (FIG. 2) in accordance with one embodiment of the present invention. The elastic band of FIG. 2 has scallops 2 on the side of the stitch selvedge $2^1$ thereof, while there can be optional scallops on the opposite edge made in a conventional manner, i.e., without selvedge. The invention is not limited to the elastic band of FIG. 2. In fact, the band can have two stitch selvedges with ornamental scallops made according to the present invention. In this case it is sufficient to provide a second device similar to the one which will be described later, and disposed symmetrically to the first one, the manufacturing process being the same. However, for more clarity in describing the invention, there will be shown formation of scallops on the existing stitch selvedge only on one edge of the elastic band.

FIG. 3 illustrates the means for embodying the manufacturing process. The thrower 3, which design is novel and useful for the present invention in that it is provided at its free end $3^1$ with a cutout, with horizontal axis, $3^2$ for the engagement and guiding at one time of one or more elastic or nonelastic yarns. In a conventional manner, the thrower 3 is provided adjacent to the cutout $3^2$ with an eyelet $3^3$ for the passage and guiding of the weft yarn while the band of fabric is being processed.

FIG. 4 is a diagram of a conventional meshing of a band with warp threads 4, weft yarns 5, and a filler yarn 6.

FIGS. 5 and 6 show the product obtained by the process of the present invention in the formation of scallops on the selvedge edge of the mesh. This product includes a filler yarn 7 forming the course of the chain, warp threads 8, weft yarns 9, a first elastic yarn 10, hereinafter called "head-rubber yarn", is inserted within the chain formed by the filler yarn 7, between the loops $7^1$ and the mesh of stitch legs $7^2$. The head-rubber yarn forms the external portion of the scallops, and is characterized by a low tension.

According to an important feature of the invention, the rounded form of the scallop is made by providing a second elastic yarn 11 hereinafter called "binding-rubber yarn", originating from the body of the article, as shown in FIGS. 5 and 6. The binding-rubber yarn is inserted according to a pre-determined cycle, in the same passage with the head-rubber yarn 10, i.e., between the same loops $A^1$ and the same stitch legs $A^2$ of the chain. The binding-rubber yarn has a tension higher than the tension of the head-rubber yarn. It will be appreciated that, owing to this characteristic of elasticity, the binding-rubber yarn tends to retract back towards the body of the article and in the plane of the head-rubber yarn and chain assembly at the points corresponding to the pre-determined cycle. This forms a longer or shorter scallop as defined by the product illustrated in FIG. 2.

An advantage of the invention is that it is possible to process the article with very fine yarns. This was not possible heretofore, as the yarns had no holding.

It is also possible with the present invention to manufacture articles woven with original patterns, as the filler yarn can be optionally colored, as well as the head-rubber yarn, which may be colored by covering with colored thread.

Another advantage of the invention is that non-elastic or elastic articles woven in accordance with this method, with straight edges or with scallops, are runproof.

The operation of the method and apparatus will now be explained as illustrated in FIGS. 7 to 13 of the drawings for the embodiment of formation of scallops on the stitch selvedge of an elastic band.

FIG. 7 corresponds to the starting position. All the yarns are in shed middle, the thrower 3 is drawn in, lever 12 of the filler yarn 7 is moved down. The selvage needle 13 is in the knocked down or doffing position while the reed 14 is in the forward beaten-up position. The weft yarn is normally disposed lengthwise. The head rubber yarn 10 is inserted within the chain formed by the filler yarn 7 in a conventional manner.

Figure 8:
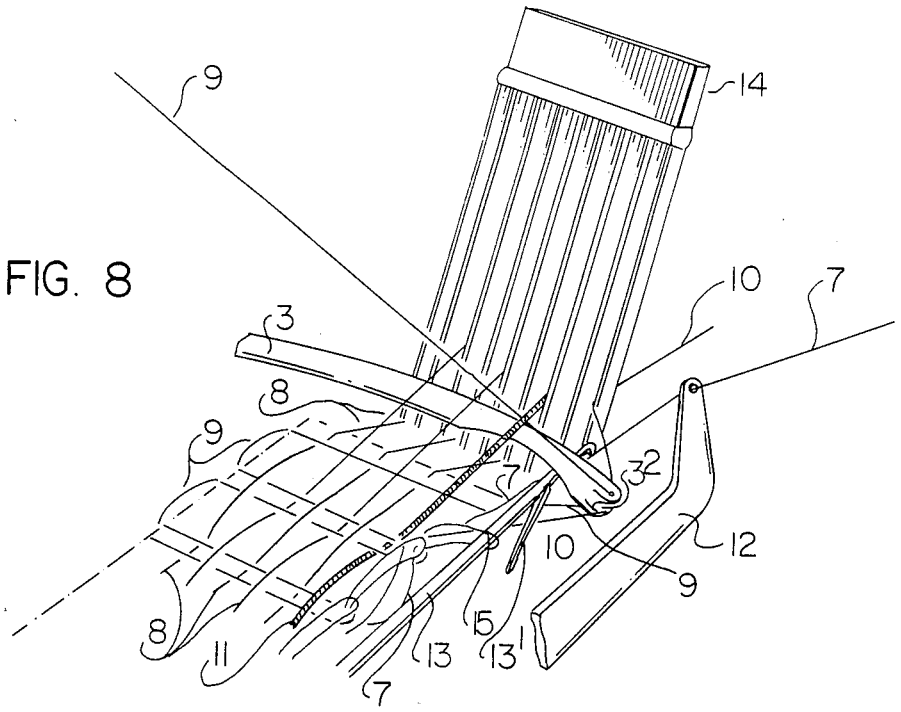

According to FIG. 8 the warp threads 8 of the body of the article are in the open shed position, directed downwardly (ends $8^1$); the binding-rubber yarn 11 is in upward shed (ends $11^1$); the head rubber yarn 10 remaining in the half-shed position corresponding to the position of FIG. 7 is picked up, then guided by the cut out portion $3^2$ of the thrower 3 during the first pass. The shifting of the thrower transverse to the elastic ban brings the head rubber yarn 10 to the level of needle 13 in the same limit position as the weft yarn 9. The needle 13 which has been shifted forward and its valve $13^1$ being open, and the lever 12 of filler yarn 7 are in the filler yarn picking up postion for the formation of conventional knits. Reed 14 is in the rearward position. A loop formed from the filler yarn is grasped around the body of the needle.

Figure 9:
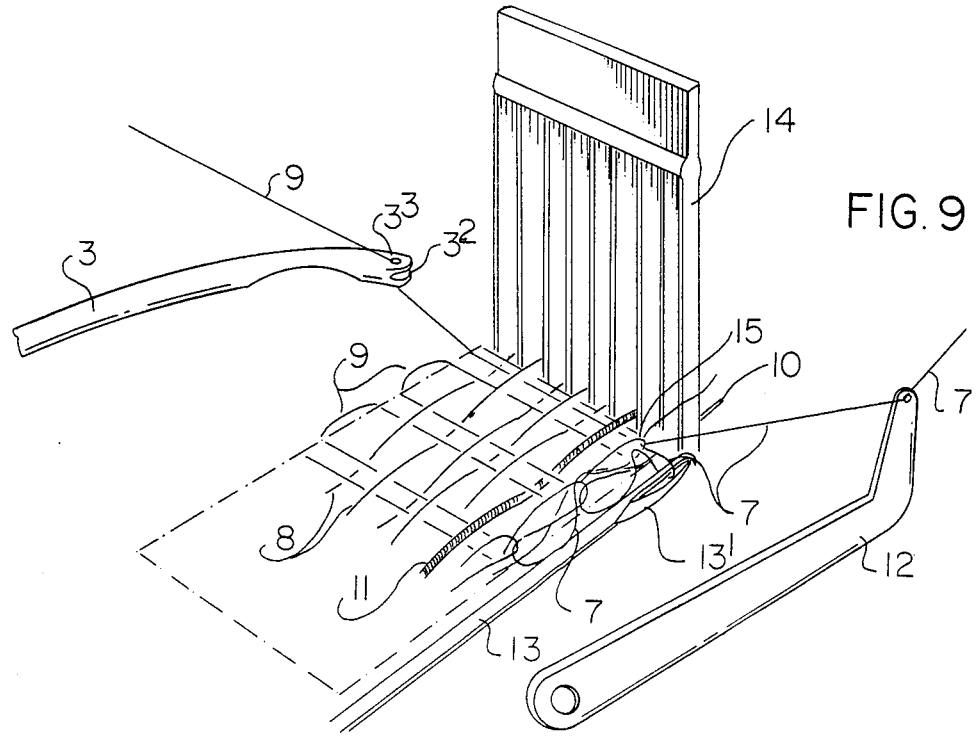

According to FIG. 9, the mechanisms return to the initial position shown in FIG. 7. When the needle returns to its initial position, loop 15 becomes active and causes the valve of the needle to be closed. The loop then falls out, and by knocking down and doffing the knit which has just been picked up at the position as shown in FIG. 7, the warp thread 9 and the head-rubber 10 are inserted together in the mesh.

Figure 10:
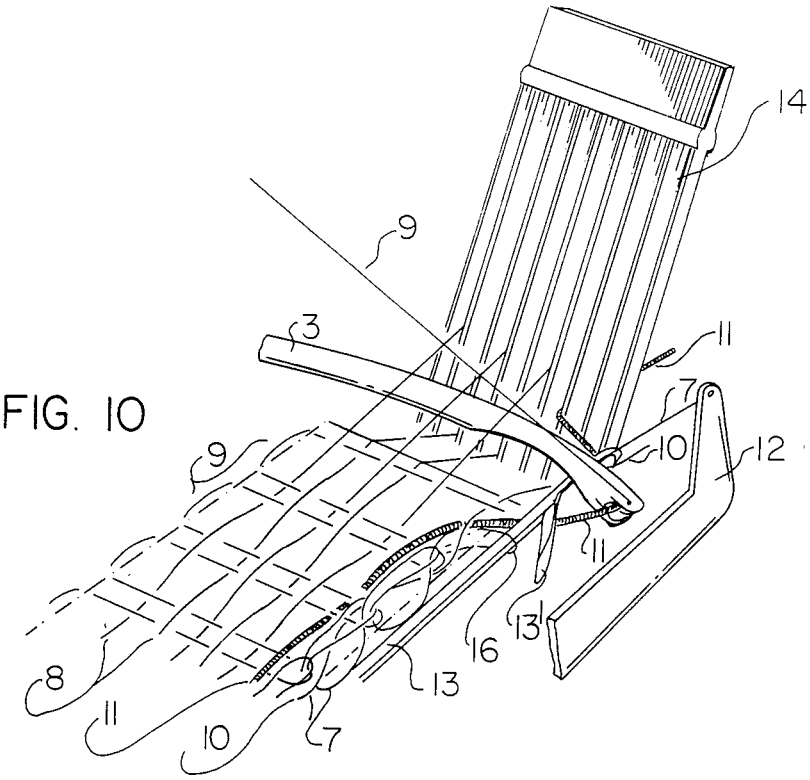

In FIG. 10, the mechanisms return to the position corresponding to FIG. 8, i.e., a further pass is performed by the thrower 3, the needle 13 has been shifted forward, and valve $13^1$ is open. The head-rubber yarn 10 is in the low shed position, and therefore in its normal warp thread postion. The binding-rubber yarn 11 has been brought to the half-shed position, and then has been picked up by the cut out $3^2$ of the thrower 3. Consequently, the binding-rubber yarn has been brought to the level of needle 13, in the same position as the weft yarn. In this position, a loop 16 has been formed, and the body of the needle is surrounded by this loop.

Figure 11:
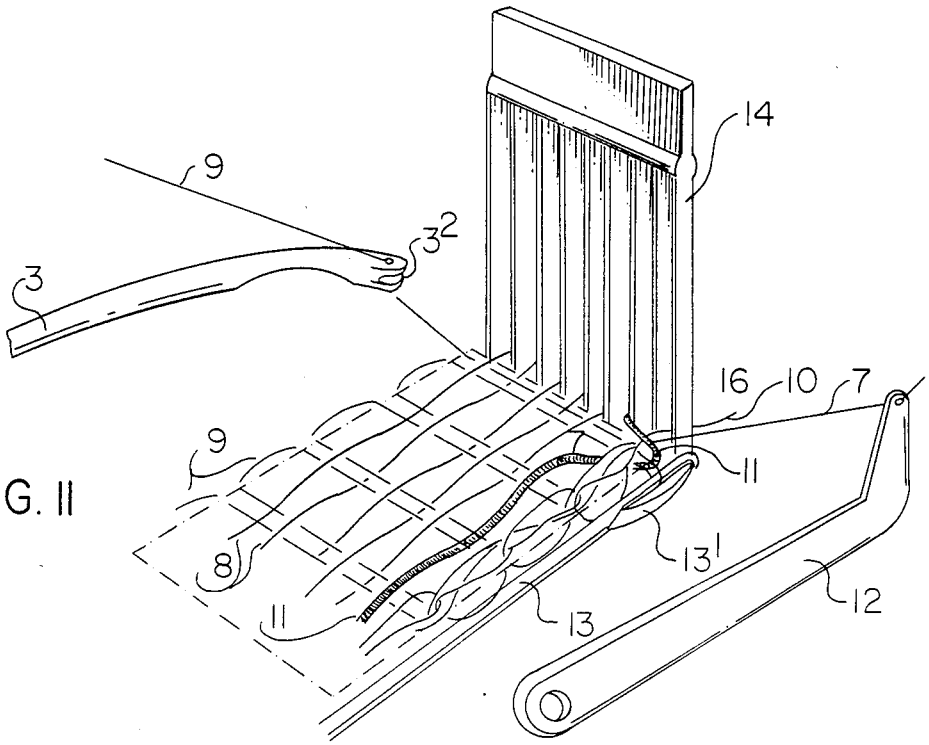

In FIG. 11, the mechanisms have returned to the initial position illustrated in FIG. 7, and the weft yarn and the binding-rubber yarn are inserted within the knit. The hooding of the scallop to the body of the article, therefore, takes place during the steps illustrated in FIGS. 10 and 11. At least one hooking is required to form a scallop. In accordance with the method described, it will be noted that the head-rubber yarn is opposite the binding-rubber yarn relative to the loop formed by the weft yarn.

Figure 12:
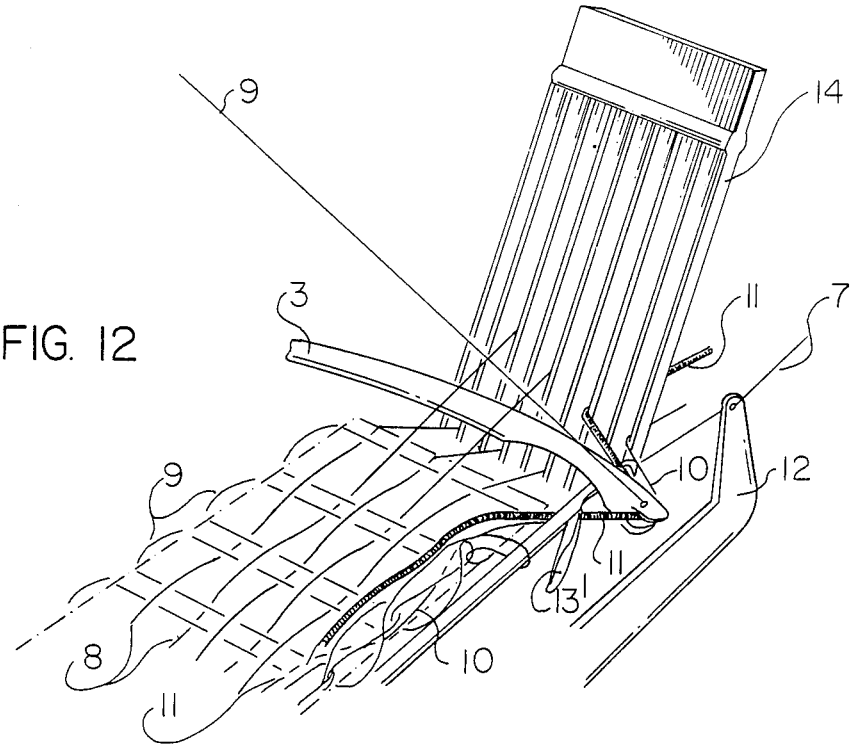

As an alternative, shown in FIGS. 12 and 13, the insertion of the binding-rubber yarn 11 is performed simultaneously with the head-rubber yarn. In this case, the two yarns are in a half-shed position, and at the time of the pass of the thrower, the thrower by means of its cut out position, picks up the two yarns and brings them to the level of the needle 13, at the same level as the weft yarn. As the mechanisms are returned, the weft yarn, the head-rubber yarn, and the binding-rubber yarn are inserted within the knit.

The mechanisms of the invention will be clearly understood by the particular shiftings of each type of yarn. The head-rubber yarn defines a half-shed, either top-middle or down-middle, whereas the threads of the body of the article define a normal top-down shed. For instance, the head-rubber yarn is processed in accordance with the conventional weaving method. This yarn is therefore, according to the pre-determined cycle, in the half-shed position, as is consequently brought at the same time at the weft on the needle side relative to the body of the article. The head-rubber yarn is inserted in the same passage as the weft, within the mesh formed by the filler yarn. At the next loom stroke, the head-rubber yarn is returned to its initial position, either top shed or down shed, and by reason of this return, the yarn is picked up by the next mesh.

The binding-rubber yarn is brought to the half shed position (FIGS. 12 and 13) at the same time as the head-rubber yarn. It is inserted in the same passage as the weft and the head-rubber yarn. Upon the next loom stroke, this binding rubber yarn is returned to the initial position, and, by reason of this return, it is picked up by the next mesh.

The tension difference between the two elastic yarns brings towards the body of the article the binding point formed in the meshes of the filler yarn by the head-rubber yarn, the weft yarn, and the binding-rubber yarn. The insertion pitch of the binding-rubber yarn may be varied to obtain various patterns.

The object of the invention is clearly apparent, as well as the many various applications thereof. It is possible to make shoulder straps with symmetrical scallops on a loom with opposite double thrower. A filler yarn supply on both selvedges is then available.

When manufacturing a scallop in accordance with the method practiced on a loom with double thrower or double weft-winder, with or without filler yarn, by direct meshing of the two wefts, the two wefts are of different width. The body of the article is normally woven by one of these wefts, whereas the other weft, which is shorter corresponds approximately to the width of the mesh or stitch-selvedges. The head-rubber yarn is laid flat against the stitch selvedge by the secondary thrower in the shorter weft, whereas the main thrower provides shifting of the main article. The binding-rubber yarn is picked up by the secondary thrower, and is brought within the shorter weft at the same time as the rubber head yarn, to obtain the same hookings as the ones which have been defined hereinbefore.

A further advantage of the invention is that the product made in accordance with the invention is runproof. A major disadvantage of the hooked selvedge articles is the fact that these products are likely to run. The mechanism for embodying the method in accordance with the invention makes it possible to obviate this inconvenience.

In the embodiment shown in FIG. 14, to make the drawing more clear, the positioning of the head-rubber yarn and the binding rubber yarn has not been shown. Two or more rigid or elastic filler yarns 22–23 are used, cooperating at each strode with a weft yarn 25, by processing them alternately in accordance with a predetermined pitch. If one of the meshes is cut off, no raveling is possible.

An alternate form of the system is illustrated in FIG. 15. In this case, the weft yarn and the filler yarn are no longer used, and two or more binding yarns 26–27 play alternately the part of weft yarns, these two yarns being picked up and shifted transversely by the thrower.

In another embodiment, several elastic or nonelastic yarns of the warp threads are shifted from their normal working position in the thrower, and are either meshed or inserted within the mesh to obtain embroidery patterns or runproof articles.

Another application of the invention is the manufacture of check materials. The device described herein makes it possible to transform a conventional loom with single weft-winder, and the derivatives thereof, into an actual loom known as "pick and pick". A range of colored yarns is then disposed on different blades of the reed, in the warp thread position on the selvedge opposite the mesh.

At each stroke of the loom, with or without weft in the eyelet of the weft-winder, a yarn of different color is selected. This yarn is then picked up and shifted crosswise by the thrower, to be wither meshed or inserted within the mesh to make a check material or any other desired pattern.

FIGS. 16 and 17 show two other embodiments of the thrower. According to FIG. 16, the thrower is equipped with a roller 17 which is mounted on a pin 18 located within the body of the thrower and to the rear of the eyelet $3^3$ for the passage of the weft to prevent overtensions and breakings that could occur on the yarns.

In FIG. 17, the thrower 19 includes at the free end thereof a broad cut-out $19^1$ with horizontal axis, so that a yoke $19^2$ is formed at the end of the thrower for positioning a pin 20 supporting an incurivated spool 21 which rotates freely around its axis. The suitable yarn is picked up by the thrower through this spool, while preventing overtensions of the yarn.

The invention has many advantages, including the simplicity of the mechanism for embodying the manufacturing process and the many possible applications of the invention.

I claim:

1. A method for making scallops on at least one selvedge of a woven elastic band comprising, forming the scallops on each selvedge, hooking at least one elastic thread in the direction of the warp and shifting at least one elastic thread transverse to the body of the band, the shifting of at least one elastic thread being effected according to a predetermined cycle, at least one elastic thread being thereinafter incorporated within the selvedge.

2. The method of claim 1 wherein elastic yarns under different tension are incorporated in a chain forming the mesh course of each selvedge, the elastic yarn under lower tension forming the external rounded portion of the scallop, the elastic yarn under higher tension being held during formation of the scallop and allowing it to assume a rounded form.

3. The method of claim 2 wherein the yarns under different tension are picked up independently, both yarns being disposed in the same mesh and in a position opposite to a loop formed by a weft yarn which has been fed at the same time.

4. The method of claim 2 wherein the yarns under different tension are picked up at the same time, both yarns being disposed in the same mesh on the same side relative to a loop formed by a weft yarn which has been fed at the same time.

5. The method of claim 1 wherein at least one binder yarn is picked up alternately according to a predetermined cycle by a finder yarn lever in order to make a runproof product.

6. The method of claim 1 wherein several yarns of a warp thread sheet are shifted transversely to their normal working position and are inserted within the selvedge.

7. The method of claim 1 wherein at least two binder yarns are picked up and function alternately as a weft yarn, the binder yarns being picked up and then shifted crosswise.

8. The method of claim 1 wherein checked materials are made wherein at least one thread in the warp direction is hooked and shifted transversely to the body of a band in a predetermined cycle, the at least one thread being thereinafter inserted with the selvedge of the band, wherein a plurality of colored yarns on the selvedge opposite the mesh are disposed in a position of warp threads on different teeth of a reel, a yarn of different color being selected at each stroke of a loom, this yarn being picked up and then shifted crosswise to be inserted within the mesh.

9. The method of claim 1 wherein the hooking and shifting of at least one warp thread is performed by a thrower forming a single means for shifting the at least one warp thread.

10. The method of claim 9, wherein the shifting and hooking of the warp thread by the thrower is accomplished with the thrower having an opening adjacent to its face end t hrough which weft yarn is guided and has means for engaging and guiding at least one warp thread.

11. The method of claim 10 wherein the thrower is provided, rearwardly of the opening, with an idle roller mounted on a pin located in the body of the thrower.

12. The method of claim 10 wherein the external rim of the free end of the thrower is provided with a cut-out having a horizontal axis for the engagement of at least one warp thread.

13. The method of claim 12 wherein the cut-out forms a yoke at the end of the thrower for positioning a pin supporting a spool which rotates fully around the pin, the spool providing for engagement of at least one warp thread upon crosswise shifting of a weft-inserting member.

14. A method for making a scallop on at least one selvedge of an elastic band wherein a first yarn is laid against the selvedge by a secondary weft-inserting member, and a binding rubber yarn is brought within the first yarn at the same time as is a head-rubber yarn.

* * * * *